US005199286A

United States Patent [19]

Jakubas

[11] Patent Number: 5,199,286

[45] Date of Patent: Apr. 6, 1993

[54] DRUM LOCK DEVICE

[75] Inventor: Gary P. Jakubas, Rutherford, N.J.

[73] Assignee: Taurus Precision, Inc., Totowa, N.J.

[21] Appl. No.: 808,230

[22] Filed: Dec. 16, 1991

[51] Int. Cl.[5] ..... B65D 55/14

[52] U.S. Cl. ..... 70/230; 137/539; 137/454.5; 70/164

[58] Field of Search ..... 70/232, 230, 164, 229, 70/231, 165, 175-177, 180; 277/112; 137/539, 454.5

[56] References Cited

U.S. PATENT DOCUMENTS

| | | | |
|---|---|---|---|
| 1,563,224 | 11/1925 | Peabody | 70/180 |
| 1,599,685 | 9/1926 | Spaeth | 70/165 |
| 1,806,124 | 5/1931 | Smith | 70/230 |
| 1,814,343 | 7/1931 | Smith | 70/230 |
| 2,021,745 | 11/1935 | Pfefferle et al. | 277/112 |
| 2,107,704 | 2/1938 | Kronquest | 137/539 |
| 2,315,644 | 4/1943 | Nahm | 70/165 |
| 2,489,787 | 11/1949 | Knowlton | 137/539 |
| 2,677,939 | 5/1954 | Clute | 137/454.5 |
| 4,197,875 | 4/1980 | Schieferstein et al. | 137/539 |
| 4,426,863 | 1/1984 | Gillette et al. | 70/230 |
| 4,458,711 | 7/1984 | Flider | 137/73 |
| 4,498,680 | 2/1985 | Schobbe | 277/112 |
| 4,655,060 | 4/1987 | Jakubus | 70/230 |
| 4,788,840 | 12/1988 | Wilson, Jr. | 70/230 |
| 4,864,834 | 9/1989 | Waite | 70/14 |
| 4,959,980 | 10/1990 | Phillips | 70/164 |

*Primary Examiner*—Richard E. Moore
*Assistant Examiner*—Darnell M. Boucher
*Attorney, Agent, or Firm*—Siegmar Silber

[57] ABSTRACT

A locking device for a drum for chemical- and hazardous-waste containment is described. The locking devices are of drums, usually 30- or 55-gallon sizes, of the closed-end type having a head with two openings or bung holes therethrough. Each drum opening has a flanged or internal portion with interior threads. The locking device has three basic elements, namely, a pair of caps and a slip wrench/locking bar. In one embodiment, one of the caps includes an overpressure relief valve and an flame arrester. Each cap has a threaded base and a larger apertured cylindrical portion mounted thereon. Each cap has a closure gasket mounted at the shoulder formed between the base and the apertured cylinder which gasket permits partial rotation without unsealing the drum. The cylindrical portion of the outer wall has at least two pairs of elongated apertures with 180-degree spacing between the apertures of each pair. The apertures extend, with the cap installed, in the corresponding opening, beyond and external to the drum head with the elongation of the aperture substantially axial to the drum. In operation, the slip wrench looking bar extends through the elongated apertures of both caps and has provision for a padlock installation at one end.

14 Claims, 2 Drawing Sheets

DRUM LOCK DEVICE

BACKGROUND OF THE INVENTION

1. Field of the Invention

This invention relates to a drum lock device for chemical- and hazardous-waste containers, and, more particularly, to a locking device structure drum wherein, upon with the locking bar inserted through the cap apertures and a padlock being embraced through the locking bar, the caps are secured and the drum is sealed.

2. Information Disclosure Statement

The inventor and his assignee have extensive backgrounds in manufacturing and distributing drum lock devices, and hold several patents in the field.

Drums containing pharmaceuticals, petroleum products, liquid chemicals and the like are usually provided with a bung hole and a vent hole in their top portion or cover. These holes are generally plugged with threadable plugs to prevent leakage. However, such drums are often subject to contamination and theft of its contents while in storage and it is highly desirable to provide means to prevent unauthorized access to such drums.

In the past devices have been proposed to effect such unauthorized access. These devices include those described in U.S. Pat. No. 4,655,060, issued Apr. 7, 1987 and U.S. Pat. No. 4,957,317 issued Sep. 18, 1990 to the inventors hereof. Of the two previously cited patents, the U.S. Pat. No. 4,655,060 is most closely related to this disclosure. U.S. Pat. No. '060 had a field of search involving various subclasses of Class 70, namely, Subclasses 164, 165 and 229–231 and discussed in the introduction, U.S. Pat. No 1,599,685 to C. Spaeth and U.S. Pat. No. 1,806,124 to W. H. Smith.

In U.S. Pat. No. '685, a closure member for metal containers is described having a flat top and a flanged portion to enable a wrench to be engaged. The member has a cylindrical body portion threaded internally and externally which is adapted to be threaded into the threaded opening of a seating and connecting ring or collar. A stud having an eye is secured to the top of the closure adapted to receive the shackle of a padlock. A smaller horizontal opening is formed within the stud at right angles to the eye opening. A closing cover is fitted over the top of the closure member to prevent the stud from being engaged by a wrench when not desired, if a padlock is used in the eye.

In U.S. Pat. No. '124, a locking device for a container having a bung plug and a vent plug is provided. A top plug is threaded into the bung and vent plugs, each top plug having an eye. Two rods having rings at both ends, are slid through the eye of each top plug and the inner rings of each rod are connected by a padlock.

In preparation for this application, a search was conducted to update the information at hand and uncovered U.S. Pat. No. 4,788,840 to D. J. Wilson, Jr., and U.S. Pat. No. 4,959,980 to M. S. Phillips.

U.S. Pat. No. '980 illustrates one attempt at a security device in which a securing bar holding captive a prob on top of one cap and fitting over a shackle provision integral with the top of the second cap is proposed. Here, the caps have box wrench provisions intermediate the ends thereof, which are covered by a freely rotating isolating covers installed between the securing bar and the caps.

U.S. Pat. No. '840 shows in contrast to the above a telescoping locking bar with interlocking lugged ends which, in turn, fit into interlocking lugged caps.

The present invention, on the other hand, provides an efficient and effective locking device for drums and other containers containing two alignable openings which is easy to install and offers benefits previously unknown to the art.

SUMMARY

In general terms, the invention disclosed hereby includes a locking device for a drum for chemical- and hazardous-waste containment. The drums, usually 30- or 55-gallon sizes, are of the closed-end type which have a head with two openings or bung holes therethrough. Each opening has a flanged or internal portion with interior threads. The locking device has three basic elements, namely, a pair of caps and a slip wrench-/locking bar. In one embodiment described hereinbelow one of the caps includes an overpressure relief valve and a flame arrester. Each cap has a threaded base and a larger apertured cylindrical portion mounted thereon. Each cap has a closure gasket mounted at the shoulder formed between the base and the apertured cylinder which gasket permits partial rotation without unsealing the drum. The cylindrical portion of the outer wall has at least two elongated apertures with 180-degree spacing. The apertures extend, with the cap installed in the corresponding opening, beyond and external to the drum head with the elongation of the aperture substantially axial to the drum. In operation, the slip wrench locking bar extends through the elongated apertures of both caps and has provision for a padlock installation at one end.

OBJECT AND FEATURES OF THE INVENTION

It is an object of the present invention to provide an economical locking device for a 30- or 55-gallon drum.

It is a further object of the present invention to provide a locking device which is easy to install.

It is yet another object of the present invention to provide a locking device which discourages tampering.

It is still yet another object of the present invention to provide an inexpensive drum lock with overpressure protection.

It is a feature of the present invention that the bung hole caps have alignable apertures.

It is another feature of the present invention to have elongated apertures to accommodate change in drum head flatness.

It is yet another feature of the present invention to have an overpressure relief mechanism together with a flame arresting construction.

Other objects and features of the invention will become apparent upon review of the drawings and the detailed description which follow.

BRIEF DESCRIPTION OF THE DRAWINGS

In the following drawings, the same parts in the various views are afforded the same reference designators.

DESCRIPTION OF THE PREFERRED EMBODIMENT

Figures 1, 2:
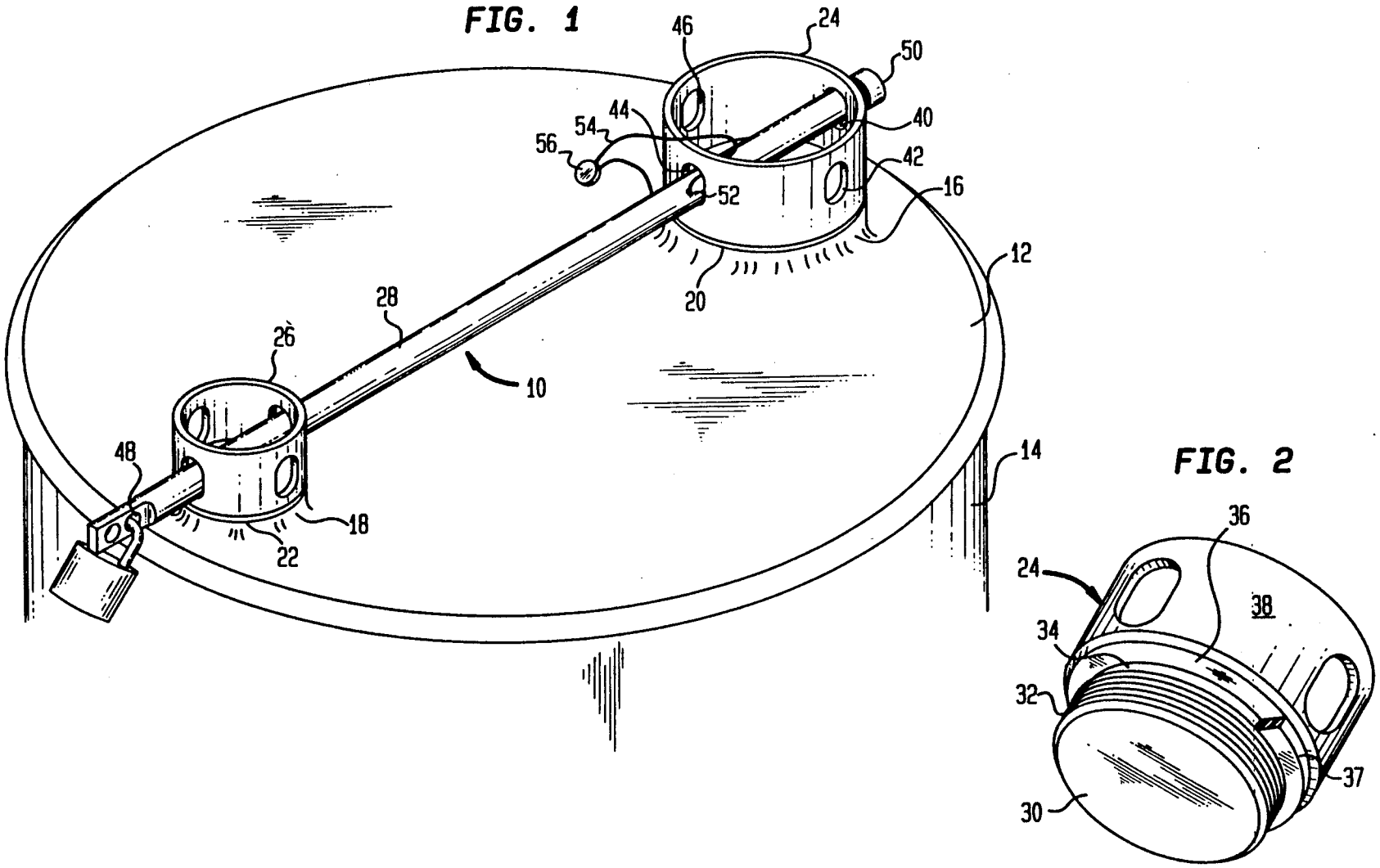
FIG. 1 shows a perspective view of the top section of a drum with the locking device of this invention and a padlock installed thereon.
FIG. 2 shows the threaded caps component of the locking device of the first embodiment of the present invention; and, FIG. 3 is a cross sectional view of the second embodiment of the locking device of this invention.

Referring to FIG. 1, the locking device of the first embodiment of this invention is referred to generally by the numeral 10, which locking device is shown mounted on a drum 12, such as a 30- or 55-gallon chemical drum. The top portion 14 of the drum 12 has a relatively large bung hole or opening 16 on one side thereof and a relatively small bung hole or opening 18 disposed oppositely on the other side. The sides of the bung holes 16 and 18 have internally threaded flange portions 20 and 22, respectively. The device 10 of the invention includes three main elements, namely, a pair of caps 24 and 26 and a slip wrench/locking bar 28. Except for scale, the two caps 24 and 26 are substantially the same, and thus for purposes of economy are both described with reference to FIG. 2. The caps, of which cap 24 is taken as typical, are now described. The cap 24 has a base 30 with an externally threaded portion 32 for threadably engaging the corresponding bung hole or drum opening 16. Adjacent the threaded portion 32 and in the exterior wall of the cap is a gasket groove 34 and shoulder 36 for receiving a suitably resilient closure gasket 37. From shoulder 36, the exterior wall 38 rises to form a substantially open cylinder thereon. A plurality of apertures 40, 42, 44 and 46 are constructed in the wall 38. These apertures are paired with 180-degree spacing therebetween. In the four aperture version, the apertures are 90 degrees apart. The apertures, when viewed with the cap installed in the corresponding drum opening, are seen to be elongated along an axial direction. The slip wrench locking bar 28 is equipped with one or more shackle openings or holes 48 at one end and a knob or flange 50 at the other. The diameter of the latter being greater than the opening of any of the apertures. All elements are preferably made of free machining brass to provide a nonsparking medium, prevent corrosion and prolong wear. Optionally, however, they may be made of a cast brass, malleable cast iron, plastic, stainless steel, or zinc or chrome plated metal. The slip wrench locking bar 28 is equipped with a lockwiring hole or aperture 52 which is shown in FIG. 1 with a tamper indicating lockwire 54 and seal 56.

Figure 3:
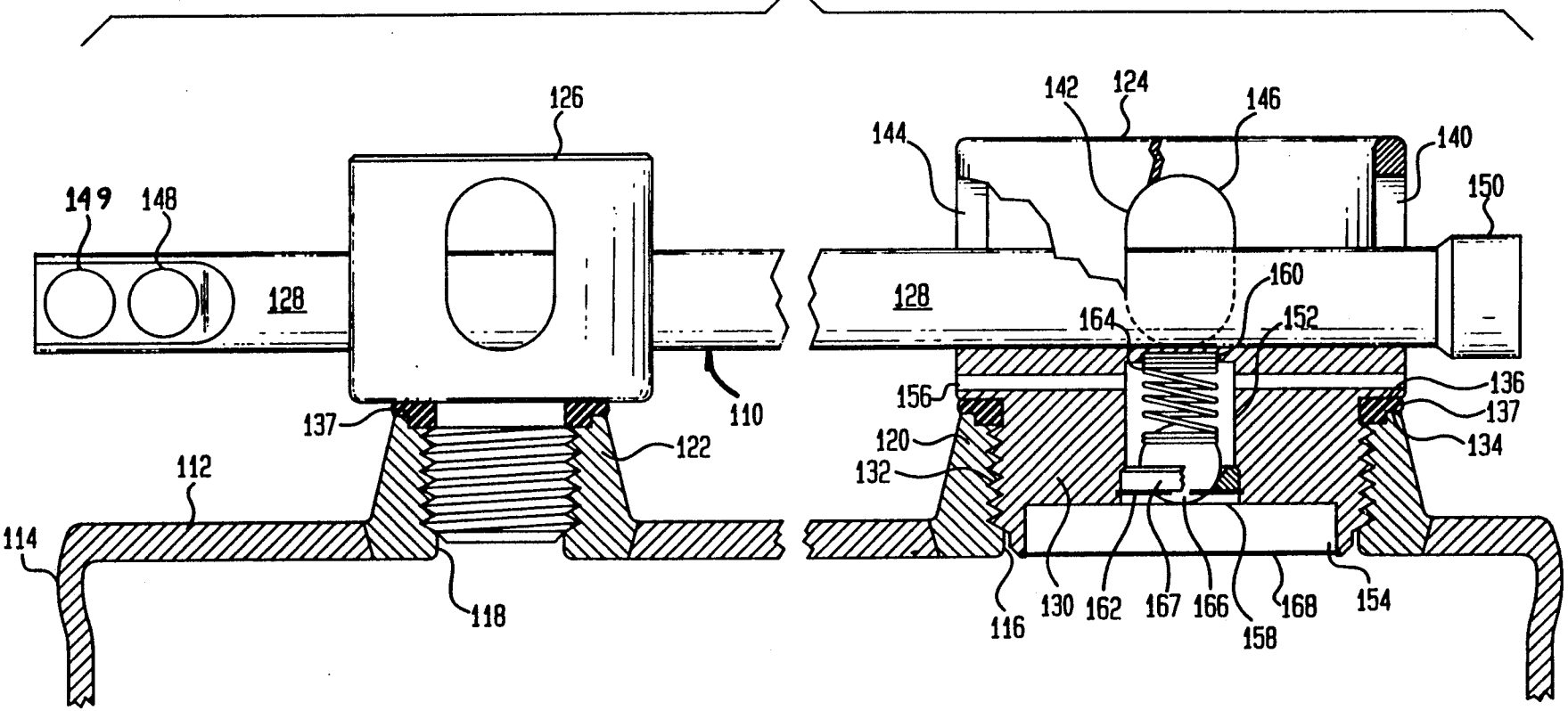

Referring now to FIG. 3, the description which follows is of a second embodiment of the locking device. For ease of comprehension, where similar parts are used reference designators "100" units higher are employed. Thus, the slip wrench locking bar 128 of the second embodiment is analogous to the slip wrench locking bar 28 of the first embodiment. The locking device of the second embodiment of this invention is referred to generally by the numeral 110, which locking device is shown mounted on a drum 112. The top portion 114 of the drum 112 has a relatively large bung hole or opening 116 on one side thereof and a relatively small bung hole or opening 118 disposed oppositely on the other side. The bung holes 116 and 118 have internally threaded flange portions 120 and 122, respectively. The device 110 of the invention includes three main elements, namely, a pair of caps 124 and 126 and a slip wrench/locking bar 128. Except for scale, the two caps 124 and 126 are substantially the same. The caps, of which cap 124 is taken as typical, are now described. The cap 124 has a base 130 with an externally threaded portion 132 for threadably engaging the corresponding bung hole or drum opening 116. Adjacent the threaded portion 132 and in the exterior wall of the cap is a gasket groove 134 and shoulder 136 for receiving a suitably resilient closure gasket 137. From shoulder 136, the exterior wall 138 rises to form a substantially open cylinder thereon. A plurality of apertures 140, 142, 144 and 146 are constructed in the wall 138. These apertures are paired with 180-degree spacing therebetween. The apertures, when viewed with the cap installed in the corresponding drum opening, are seen to be elongated along an axial direction. The slip wrench locking bar 128 is equipped with at least one shackle or hole 148 at one end and a knob or flange 150 at the other. In the second embodiment, the slip wrench locking bar 128 is equipped with two shackles 148 and 149 which enhances security by increasing the number of persons required for access. The diameter of the latter being greater than the opening of any of the apertures. For overpressure relief and safety, the cap 124 is equipped with a simple valve and flame arrester structure.

A relief channel 152 is fashioned in the base 130 with an inlet port 154 and one or more outlet ports 156. The inlet port 154 in the best mode of practicing this invention is centrally located within the threaded portion 132; the outlet ports 156 are in the exterior wall 138 adjacent the apertures 140, 142, 144 and 146. The inlet port 154 leads to a valve chamber 158 with a spring housing 160 at the end opposite the inlet port 154. A valve seat retainer 162 is adjacent the inlet port 154. Between the spring housing 160, and the valve seat retainer 162, a spring 164 captively urges a ball 166 against a valve seat 167. A flap arrester screen 168 is constructed to cover the base 130.

In operation, a drum 10 is closed by placing caps 24 and 26 into the corresponding openings. Using the locking bar 28 as a slip wrench, four of the apertures thereof are aligned so that the gasket seals are engaged and the locking bar extends through the apertures on both caps. The gasketing material is sufficiently resilient that if, upon fully closing the caps, alignment is not attained, backing off the caps sufficiently for alignment will not result in the loss of sealing. With the bar positioned as hereinbefore described, a padlock is embraced in the shackle therefor. During operation, the installation of the locking device on a slightly domed drum head or one that becomes slightly domed during storage is compensated for by the elongation of the apertures. When the locking device is prepared with a plurality of shackle openings, security is enhanced by enabling two or more parties to attach their own padlock to the locking bar. This then limits access to situations in which all key or combination holders are available. For locking purposes, the second embodiment functions identically with the first embodiment. In use, however, the valve responds to an overpressure condition wherein pressure on the ball overcomes the spring pressure and opens a passageway through the relief channel to atmosphere.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A locking device for a drum having a head with two openings therethrough, each opening having a flanged portion with interior threads thereabout, said locking device comprising, in combination:

a pair of caps, each having at one end an exteriorly threaded portion for cooperative functional relationship with a corresponding one of said flanged portions and at the other end a wall, in turn, comprising:

shoulder means for receiving a closure gasket, said shoulder means being dimensioned to fit within a corresponding one of said drum openings;

an open ended cylindrical member with a plurality of pairs of apertures therethrough having 180-degree spacing between the apertures of each pair, said apertures extending, with the cap installed in the corresponding opening, beyond and external to the drum head;

a locking bar with an elongated body dimensioned to extend, with both caps installed in the corresponding openings therefor, through the apertures of both caps, said locking bar having means for retention at one end and means for locking at the other end;

a closure gasket on said shoulder means, said closure gasket structured of a resilient material so as to permit alignment of the apertures without unsealing the drum; and, whereby, during installation of the locking bar, when the caps are rotated to align the apertures, the drum is maintained in a sealed condition; and, when the locking bar is locked, the rotation of the caps is precluded.

2. A locking device as described in claim 1 wherein said apertures in said walls are elongated with the elongation of said apertures are substantially axial and whereby, upon the drum head becoming slightly domed the locking bar is readily installed.

3. A locking device as described in claim 1 wherein said locking bar is usable as a slip wrench when disengaged from one of the two said caps and is slidable to and fro through the apertures thereof to facilitate sealing and unsealing of the drum.

4. A locking device as described in claim 1 wherein said wall includes two pairs of apertures.

5. A locking device as described in claim 4 wherein said pairs of apertures are disposed so as to space the apertures thereof 90 degrees apart.

6. A locking device for a drum having a head with two opening therethrough, each opening having a flanged portion with interior threads thereabout, said locking device comprising, in combination:

a first cap having at one end an exteriorly threaded portion for cooperative functional relationship with a corresponding one of said flanged portions and at the other end a wall with an open ended cylindrical member with at least one pair of apertures therethrough having 180-degree spacing between the apertures of each pair, said apertures extending, with the cap installed in the corresponding opening, beyond and external to the drum head;

shoulder means for receiving a closure gasket, said shoulder means being dimensioned to fit within a corresponding one of said drum openings;

a closure gasket mounted on said shoulder means, said closure gasket structured of resilient material so as to permit alignment of the apertures without unsealing the drum;

a second cap having at one end an exteriorly threaded portion for cooperative functional relationship with a corresponding one of said flanged portions and at the other end a wall with an open ended cylindrical member with at least one pair of apertures therethrough having 180-degree spacing between the apertures of each pair, said apertrues extending, with the cap installed in the corresponding opening, beyond and external to the drum head, said second cap including valve means for relieving a drum overpressure condition, said valve means, in turn, further comprising:

relief channel means for communicating between the drum interior and the atmosphere, said relief channel means extending from an inlet port lying within the threaded portion of the cap and exiting through an outlet port in the wall;

valve seat and valve assembly in aid relief channel operable between an open position with the valve lifted off the valve seat and a closed position with the valve urged against the seat;

controls spring means for urging the valve against the valve seat and, upon the occurrence of an overpressure condition, yielding thereto, said control spring means mounted in said relief channel with one portion thereof connected to the valve; and, a locking bar with an elongated body dimensioned to extend, with both caps installed in the corresponding openings therefor, through the apertures of both caps, said locking bar having means for retention at one end and means fro locking at the other end.

7. A locking device as described in claim 6 wherein said apertures in said walls are elongated with the elongation of said apertures, when viewed with the cap installed in the corresponding opening, are substantially axial to the drum.

8. A locking device as described in claim 6 wherein said locking bar is usable as a slip wrench when disengaged from one of the two said caps and is slidable to and fro through the apertures thereof to facilitate sealing and unsealing of the drum.

9. A locking device as described in claim 6 wherein each said wall includes two pairs of apertures.

10. A locking device as described in claim 9 wherein said pairs of apertures are disposed so as to space the apertures thereof 90 degrees apart.

11. A locking device as described in claim 6 wherein said wall further includes second shoulder means for receiving a closure gasket, said second shoulder means being dimensioned to fit within a the remainder one of said drum openings.

12. A locking device as described in claim 6 wherein said device further comprises a second closure gasket mounted on said second shoulder means, said second closure gasket structured of a resilient material so as to permit alignment of the apertures without unsealing the drum.

13. A locking device as described in claim 6 wherein said second cap further comprises a flame arrester interposed between the inlet port of said relief channel means lying within the threaded portion of the cap and, with the cap installed in the corresponding opening, the interior of said drum, said flame arrester attached to the outer surface of said threaded portion.

14. A locking device as described in claim 6 wherein said means for locking of said locking bar further comprises a plurality of apertures for installing two or more padlocks whereby security is enhanced by increasing the number of persons required for access.

* * * * *